US007499654B2

(12) United States Patent
Mihara

(10) Patent No.: US 7,499,654 B2
(45) Date of Patent: Mar. 3, 2009

(54) IMAGE RECORDING APPARATUS AND IMAGE RECORDING METHOD

(75) Inventor: Suguru Mihara, Tokyo (JP)

(73) Assignee: Olympus Corporation, Tokyo (JP)

( * ) Notice: Subject to any disclaimer, the term of this patent is extended or adjusted under 35 U.S.C. 154(b) by 452 days.

(21) Appl. No.: 11/345,942

(22) Filed: Feb. 2, 2006

(65) Prior Publication Data

US 2006/0177254 A1 Aug. 10, 2006

(30) Foreign Application Priority Data

Feb. 9, 2005 (JP) ..... 2005-033656

(51) Int. Cl.
*G03G 15/00* (2006.01)

(52) U.S. Cl. ..... 399/16; 399/395; 347/104; 347/153; 347/264

(58) Field of Classification Search ..... 399/16, 399/23, 66, 301, 303, 312, 389, 394, 395, 399/401, 45; 347/16, 104, 105, 106, 116, 347/139, 153, 215, 217, 262, 264; 271/227, 271/228, 265.01
See application file for complete search history.

(56) References Cited

U.S. PATENT DOCUMENTS 4,738,442 A * 4/1988 Rodi et al. ..... 271/261
6,019,365 A * 2/2000 Matsumura ..... 271/227
6,052,552 A * 4/2000 Ohsumi et al. ..... 399/394
6,356,735 B1 * 3/2002 Hozumi ..... 399/395
6,511,239 B1 * 1/2003 Kretschmann et al. ..... 400/579
6,788,322 B2 * 9/2004 Morita ..... 347/139
6,872,017 B2 * 3/2005 Kato ..... 400/283

FOREIGN PATENT DOCUMENTS

JP 2003-223088 A 8/2003
JP 2004-181659 A 7/2004
JP 2004335270 A * 11/2004
JP 2005-283675 A 10/2005

* cited by examiner

*Primary Examiner*—Robert Beatty
(74) *Attorney, Agent, or Firm*—Frishauf, Holtz, Goodman & Chick, P.C.

(57) ABSTRACT

An image recording apparatus having a transport path of a recording material, and an image recording unit in the transport path which records an image in the recording material in the process of transporting the recording material in the transport path. It includes: a recording material detection unit which is provided in the transport path and detects the edge at a side end of the recording material transported in the transport path; an operation mode determination unit for discriminating whether or not incorrect detection can be performed in detecting the edge by the recording material detection unit, and determining an operation mode based on the discrimination result; and a control unit for controlling by the image recording unit an image recording process on the recording material in the operation mode.

14 Claims, 8 Drawing Sheets

IMAGE RECORDING APPARATUS AND IMAGE RECORDING METHOD

CROSS REFERENCE TO RELATED APPLICATION

This application claims benefit of Japanese Application No. 2005-033656, filed Feb. 9, 2005, the contents of which are incorporated by this reference.

BACKGROUND OF THE INVENTION

1. Field of the Invention

The present invention relates to an image recording apparatus for detecting a recording material in advance before recording an image, and making a masking amendment to the image recording position based on the detection result.

2. Description of the Related Art

Recently, there is an increasing need for an image recording apparatus to record an image on the entire recording material in outputting an image such as a photo, graphics, etc. other than characters, charts, and tables.

To satisfy the above-mentioned need, it is necessary to record an image after correctly grasping the position of a recording material. To detect the correct position, a line sensor, etc. is normally used, and the image recording position is fed back to a control unit before recording an image.

However, for example, when the line sensor becomes dirty with a foreign object attached to the line sensor, the position of the recording material cannot be correctly detected, thereby recording an image to a portion other than the recording material, or losing the recording image information for image-recording to a recording material. The above-mentioned conventional image recording apparatus is disclosed by, for example, the patent document 1 (Japanese Published Patent Application No. 2000-223088).

The image recording apparatus according to the patent document 1 has a form sensor for detecting the slippage in position of a recording material including a light emitting device (LED) and a receiving optics, has the function of detecting the amount of slippage in the horizontal scanning direction of the recording material according to the signal from the receiving optics of the form sensor when an image is recorded, and masking the portion on the recording material other than the image recording area, and performs control of notifying an operator of an incorrect detection and stopping recording an image when there is an incorrectly detected position in the image recording area other than the masked area due to dirt, etc. attached to the form sensor.

However, as described in the patent document 1, the method of masking an area by detecting an image recording position on the recording material by the receiving optics of the line sensor, etc. is only to stop performing amending control of the image recording position or to notify an operator if the incorrect detection of the receiving optics is found in a necessary area for edge detection in the horizontal scanning direction of the recording material. When the amending control is not performed on the image recording position, it is necessary to reserve a large margin from the side edge (horizontal end), and there occurs a slippage in image recording position between the face and the reverse with the image recording apparatus having a double-sided recording mechanism.

Furthermore, according to the patent document 1, since the receiving optics detects only one edge on the recording material, the edges of both sides of the recording material cannot be appropriately masked.

SUMMARY OF THE INVENTION

To solve the above-mentioned problems, the image recording apparatus according to the present invention has a transport path of a recording material, and an image recording unit in the transport path which records an image in the recording material in a process of transporting the recording material in the transport path. The apparatus includes: a recording material detection unit which is provided in the transport path and detects the edge at the side end of the recording material transported in the transport path; an operation mode determination unit for discriminating whether or not incorrect detection can be performed in detecting an edge by the recording material detection unit, and determining an operation mode based on the discrimination result; and a control unit for controlling by the image recording unit an image recording process on the recording material in the operation mode.

The image recording method according to the present invention is a method for an image recording apparatus having a transport path of a recording material, and an image recording unit in the transport path which records an image in the recording material in a process of transporting the recording material in the transport path. The method includes: discriminating before an edge at the side end of the recording material transported in the transport path is detected whether or not incorrect detection can be performed when the edge is detected; determining based on the discrimination result an operation mode indicating whether or not an image is recorded using the detection result of the edge; calculating an appropriate mask information by detecting the edge of the recording material in the determined operation mode; and recording an image on the recording material according to the calculated appropriate mask information.

DESCRIPTION OF THE PREFERRED EMBODIMENT

An embodiment of the present invention is described below in detail by referring to the attached drawings.

Figure 1:
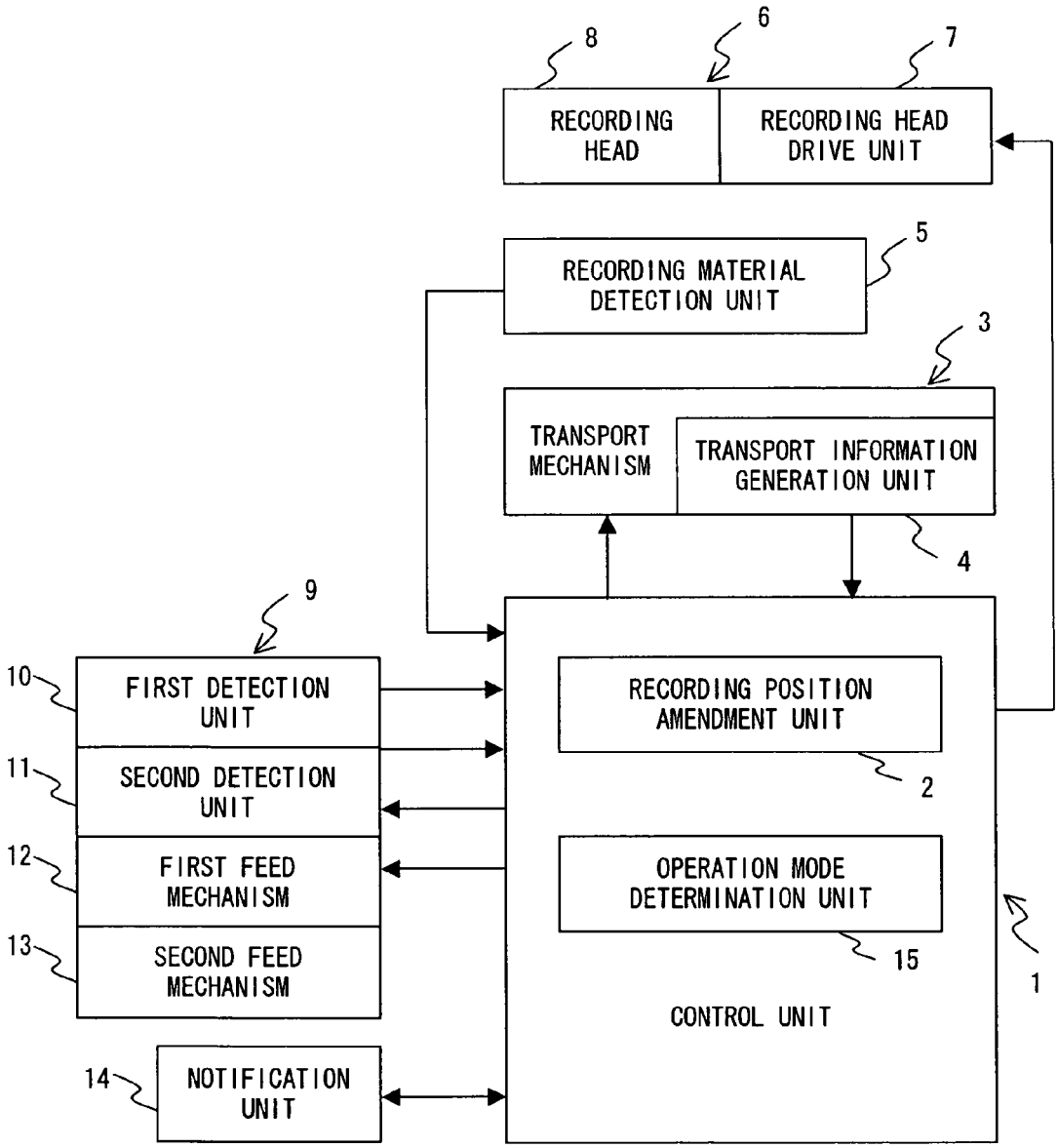
FIG. 1 shows the concept of an example of the configuration of the image recording apparatus according to the present embodiment.

FIG. 1 shows the concept of an example of the configuration of the image recording apparatus according to an embodiment of the present invention.

As shown in FIG. 1, the image recording apparatus according to an embodiment of the present invention comprises a control unit 1, a transport mechanism 3, a recording material detection unit 5, an image recording unit 6, a feed system 9, and a notification unit 14.

The control unit 1 controls the entire image recording apparatus, and integrally controls the transport mechanism 3, the recording material detection unit 5, the image recording unit 6, the feed system 9, and the notification unit 14. The control unit 1 also comprises an operation mode determination unit 15 for determining the method of detecting the edge of a recording material, and a recording position amendment unit 2 for determining the masking position on the recording material. The transport mechanism 3 transports a recording material not shown in the attached drawings, loads the recording material into the transport mechanism 3 at an instruction of the control unit 1, and transports the recording material downward in the transport path. The image recording apparatus also comprises a transport information generation unit 4 for generating transport information about the recording material when the recording material is transported. The recording material detection unit 5 comprises a sensor for detecting the recording material not shown in the attached drawings and transported downward in the transport path from the feed system 9. The image recording unit 6 records to the recording material an image based on the image data at an instruction from the control unit 1, and comprises a recording head drive unit 7 and a recording head 8 for recording an image to the recording material. The feed system 9 supplies the recording material to the transport mechanism 3, and comprises a first detection unit 10, a second detection unit 11, a first feed mechanism 12, and a second feed mechanism 13. The notification unit 14 performs an error processing about the recording material and notifies an operator of the contents of the error processing using voice and display.

Then, a practical example of the arrangement according to an embodiment of the present invention is described below.

In the following explanation, the transport direction of the recording material is defined as the Y direction (vertical scanning direction), the direction orthogonal to the Y direction is defined as the X direction (horizontal scanning direction), and the direction orthogonal to the XY plane is defined as the Z direction.

Figure 2:
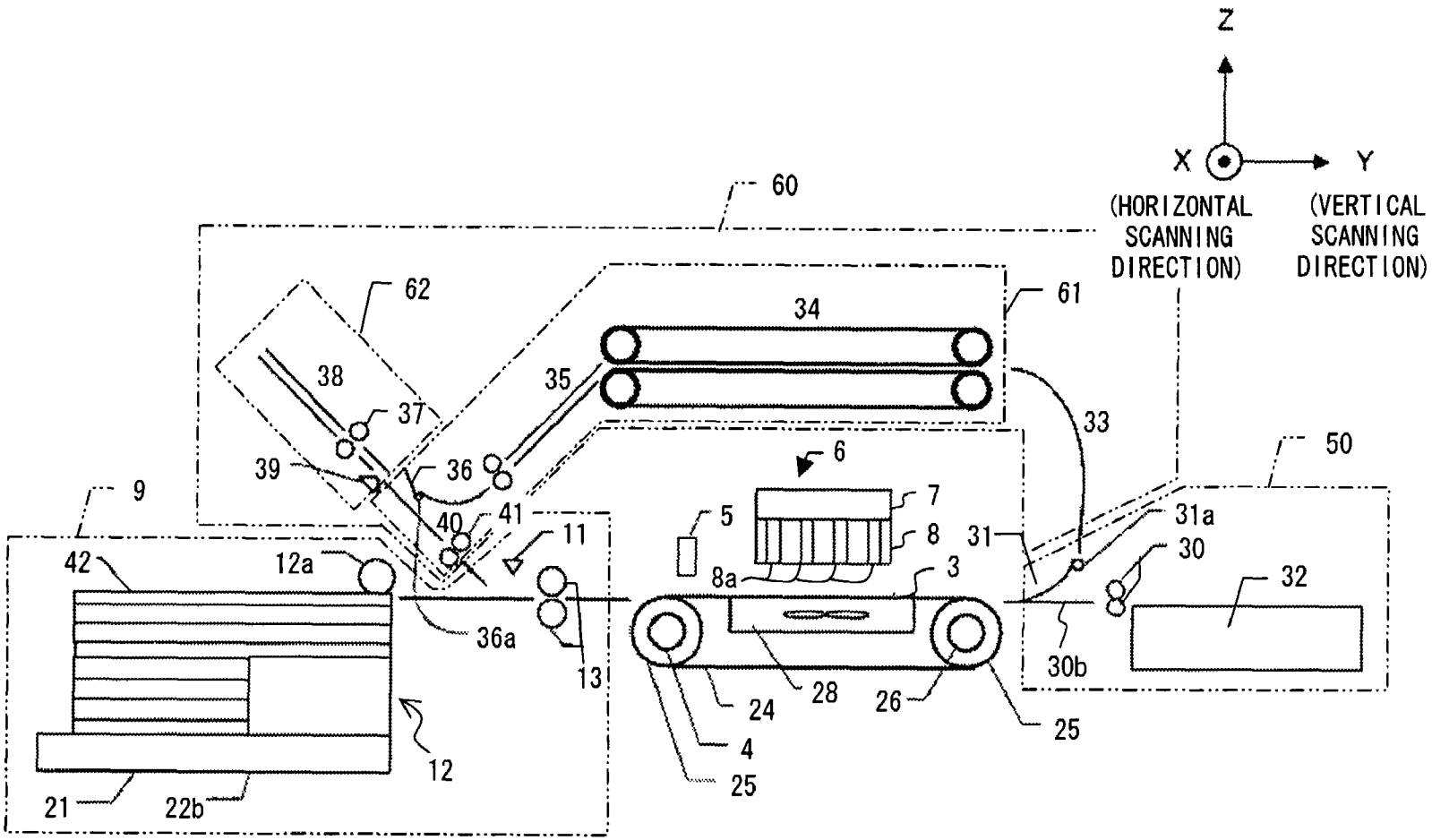
FIG. 2 mainly shows the transport path of the recording material of the image recording apparatus according to the present embodiment.
Figure 3:
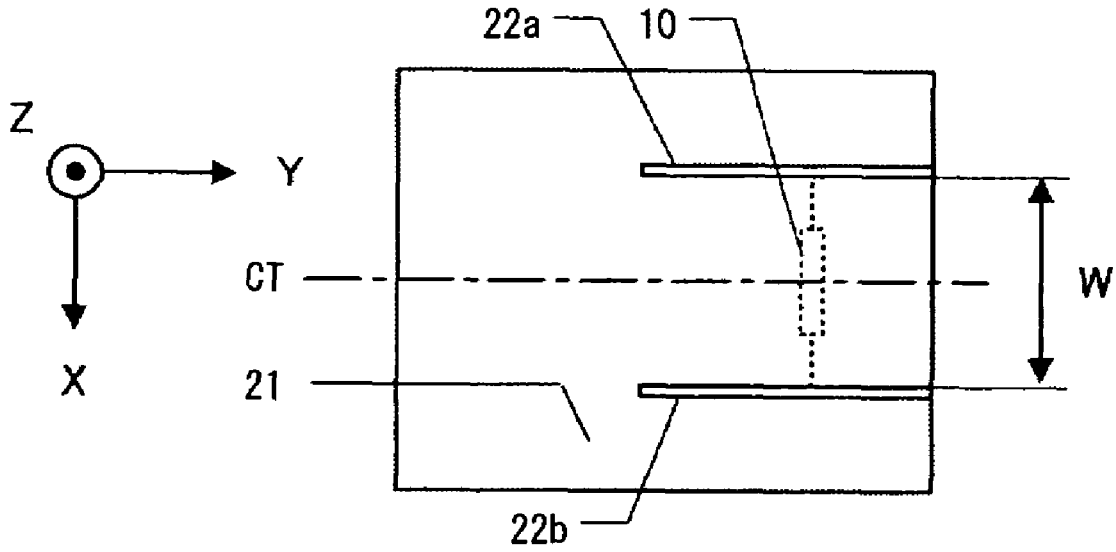
FIG. 3 is the feed table viewed from the Z direction.

FIG. 2 show mainly shows the transport path of the recording material of the image recording apparatus according to the present embodiment. FIG. 3 is the feed table 21 viewed from the Z direction.

As shown in FIGS. 2 and 3, the first feed mechanism 12 in the feed system 9 is controlled by the control unit 1, and feeds a recording material 42 stored in the feed table 21 in the transport path. For example, it comprises: a pickup roller 12*a* for feeding the stored recording material 42 sheet by sheet downward in the transport path; and fences 22*a* and 22*b* movable in the X direction depending on the width of the recording material 42 set on the feed table 21. The first detection unit 10 is provided for the feed table 21, detects the width of the recording material 42, and comprises, for example, a potentiometer whose resistance value varies depending on the width W between the fences 22*a* and 22*b*. The information based on the resistance value is transmitted to the control unit 1. The second detection unit 11 detects the end portion in the Y direction (vertical scanning direction). If the recording material 42 is transported in the transport path, and the end portion reaches the detection position of the second detection unit 11, then it is announced to the control unit 1. The second detection unit 11 comprises, for example, an optical transmission sensor.

The second feed mechanism 13 of the feed system 9 comprises, for example, a pair of registration rollers having two rollers substantially parallel in the X direction (horizontal scanning direction) and as upper and lower rollers along the Z direction. The control unit 1 allows the recording material 42 to contact the pair of registration rollers in the second feed mechanism 13 in the stop state, and allows the recording material 42 contacting the rollers to be fed for a predetermined time, thereby performing control by switching between the diagonal transport amending mode for amending the diagonal transport of the recording material 42 and the feeding mode for feeding the recording material 42 downward in the transport path by pinching and driving the recording material 42.

A common driving power transmission system not shown in the attached drawings is connected to the pickup roller 12*a* and the pair of registration rollers, and driven together. For example, a motor is connected to the driving power transmission system. The motor is drive-controlled by the control unit 1, and is driven and stopped at an instruction of the control unit 1.

The pickup roller 12*a* and the pair of registration rollers are structured such that they can be freely connected to and released from the driving power transmission system using a clutch. Each clutch is turned on and off by the control unit 1 for connection to and disconnection from the driving power transmission system.

In the transport path, a registration sensor is provided in the second detection unit 11 in the feed system 9 between the pickup roller 12*a* and the pair of registration rollers. The registration sensor detects the end portion of the recording material 42 in a predetermined position in the transport path, and notifies the control unit 1 of the detection result.

The transport mechanism 3 transports the recording material 42 transmitted from the feed system 9 downward opposite the image recording unit 6. The transport mechanism 3 comprises a plurality of belt rollers 25 and an endless belt 24 mounted by the plurality of belt rollers 25. The endless belt 24 and the plurality of belt rollers 25 form a belt transport mechanism for cooperatively transporting the recording material in the Y direction. The endless belt 24 is designed to have a width exceeding the maximum width of the recording material 42 to which an image is recorded.

For example, a motor 26 is connected to one of the belt rollers 25. For example, an encoder in the transport information generation unit 4 of the transport mechanism 3 is connected to the other belt roller 25. Furthermore, a platen suction unit 28 for holding the recording material 42 by suction on the surface of the endless belt 24 is mounted between the plurality of belt roller 25 in the transport direction of the recording material 42.

Upward the transport mechanism 3 in the transport path, the recording material detection unit 5 is mounted.

The recording material detection unit 5 is structured by, for example, a line sensor (including a CCD (charge-coupled device) sensor). When the recording material 42 is transported to the detection position, the width information about the recording material 42 (width and the end positions of the recording material) in the direction orthogonal to the recording material transport direction is associated with the number of encoder pulses in the transport information generation unit 4 of the transport mechanism 3 and detected before performing an image recording operation. The recording material detection unit 5 is arranged over the width direction (X direction) of the endless belt 24 in the transport mechanism 3, and the detection signal is announced to the control unit 1. The control unit 1 allows the recording position amendment unit 2 to calculate the masking position of the image recording position according to the information notified by the potentiometer of the first detection unit 10 or the line sensor of the recording material detection unit 5.

The platen suction unit 28 generates a negative pressure downward in the transport path of the recording material 42 in the endless belt 24, and holds the recording material 42 on the endless belt 24 by suction. By holding the recording material by suction, the transport mechanism 3 transports at a constant speed downward in the transport path the recording material 42 held by suction.

The recording head 8 of the image recording unit 6 records an image on the recording material 42, have a recording width equal to or exceeding the maximum width of the available recording material 42, and is mounted in the X direction.

At the lower end of the recording head 8, a nozzle string 8*a* comprising a plurality of ink discharging nozzles arranged in the X direction is arranged at the position downward the recording material detection unit 5 in the transport path which corresponds to the position obtained by adding a predetermined number of encoder pulses to the number of encoder pulses in the transport information generation unit 4 of the transport mechanism 3 associated with the position at which the width information about the recording material 42 is first detected by the recording material detection unit 5. The number of encoder pulses associated with the position first detected by the recording material detection unit 5, and the number of encoder pulses associated with the position of the nozzle string 8*a* of the recording head 8 are stored in advance in the recording unit (not shown in the attached drawings) of the control unit 1 when the apparatus according to the present invention is adjusted and delivered.

An ejection system 50 has a mechanism for ejecting the recording material 42 to which an image is recorded by the image recording unit 6. The ejection system 50 comprises a pair of ejection rollers 30, a transport path switch unit 31, and an ejection tray 32 as shown in FIG. 2.

The pair of ejection rollers 30 have a transport roller for further transporting the transported recording material 42 to the ejection tray 32. The transport path switch unit 31 is mounted upward the pair of ejection rollers 30 in the transport path, and is supported such that it can rotate about an axis 31*a* parallel in the X direction. The end of the transport path switch unit 31 touches and detaches the ejection path to the ejection tray 32 in the ejection system 50 by the rotation. One end of the transport path switch unit 31 is connected to the axis 31*a* supported such that it can rotate by a recording material reverse unit 60, and the other end is extended to the ejection path. The transport path switch unit 31 leads the recording material 42 to the recording material reverse unit 60 when the end contacts the ejection path, and transmits the recording material 42 to the ejection tray 32 when the end detaches. The ejection tray 32 has a tray for storing the recording material 42 to which the image recording apparatus has completed recording an image.

The pair of ejection rollers 30 are also connected to the above-mentioned common driving power transmission system through the clutch not shown in the attached drawings. The clutch of the pair of ejection rollers 30 controls the connection and disconnection to the driving power transmission system at an instruction of the control unit 1, and controls the switch between drive and stop by the connection and disconnection to the driving power transmission system. The transport path switch unit 31 also controls the drive at an instruction of the control unit 1.

The recording material reverse unit 60 inverts the recording material 42 when double-sided recording is performed, and re-transports the recording material 42 to the image recording unit 6, and comprises a first transport path 33, a second transport path 61, an reverse path unit 62, and a re-feed transport path 40.

The first transport path 33 transports the recording material 42 between the ejection system 50 and the second transport path 61. One end of the system is connected to the ejection system 50, and the other end is connected to the second transport path 61. The second transport path 61 transports the recording material 42 between the first transport path 33 and the reverse path unit 62, and comprises a reverse belt unit 34 and a slope unit 35.

The reverse belt unit 34 is arranged opposite and upward the transport mechanism 3 substantially in parallel, structured as a pair of belt transport mechanisms for vertically pinching and transporting the recording material 42. One end of the unit is connected to the first transport path 33, and the other end is connected to the slope unit 35. The reverse belt unit 34 is connected to the driving power transmission system through the clutch, and rotated by the power of the driving power transmission system, thereby transporting the recording material 42 from the first transport path 33 to the slope unit 35. The slope unit 35 is a transport path to transport the recording material 42 to the reverse path unit 62. One end of the unit is connected to the reverse belt unit 34, and the other end is connected to the reverse path unit 62 through a gate 36.

One end of the gate 36 is connected to an axis 36*a* supported such that it can rotate in the second transport path 61, and the end of the unit is designed to touch and detach the reverse path unit 62.

The reverse path unit 62 is a transport path to transport the recording material 42 from the second transport path 61 to the re-feed transport path 40, and is connected to the second transport path 61 and the re-feed transport path 40. The reverse path unit 62 has a pair of reverse rollers 37 for pinching the recording material 42. The pair of reverse rollers 37 transports the recording material 42 to a reverse auxiliary path 38 or the re-feed transport path 40 by the reversible driving system comprising a motor, etc. through an electromagnetic clutch not shown in the attached drawings. The reversible rotation mechanism is driven and controlled by the control unit 1.

The reverse path unit 62 is provided with an end portion detection sensor 39 at the connection end portion to the re-feed transport path 40. The end portion detection sensor 39 detects the end portion of the recording material 42, and notifies the control unit 1 of the detection result.

The re-feed transport path 40 is a transport path to transport the recording material 42 from the reverse path unit 62 to a pair of registration rollers. The re-feed transport path 40 comprises a pair of re-feed rollers 41, and transports the recording material 42 from the reverse path unit 62 to the pair of registration rollers.

The pair of re-feed rollers 41 are arranged within the distance between the recording material 42 and the pair of registration rollers in the transport direction of the recording material 42 along the transport path of the recording material 42 of the reverse path unit 62 such that the recording material 42 can be correctly transported. With the configuration, when the end of the recording material 42 being transported touches the pairs of registration rollers, the rear end of the recording material 42 is nipped by the pair of re-feed rollers 41. Therefore, the pair of re-feed rollers 41 help transport the recording material 42 until at least the end of the recording material 42 is nipped by the pair of registration rollers as the pickup roller 12*a* explained by referring to the feed system 9.

The control unit 1 having the recording position amendment unit 2 and the operation mode determination unit 15 shown in FIG. 1 comprises, for example, a CPU (central processing unit), a timer, ROM (read-only memory), RAM (random access memory), a recording unit, etc. By the CPU executing the program on the ROM and RAM and processing each piece of notified information, the feed system 9, the transport mechanism 3, the image recording unit 6, the ejection system 50, and the recording material reverse unit 60 shown in FIG. 2 are driven and controlled. The control unit 1 determines the area in which an image is recorded by the CPU executing a program on the ROM an the RAM obtaining the position of both end portions of the recording material 42 in the transport path according to the detection result by the recording material detection unit 5 described later and the information from the first detection unit 10.

Next, the operation of the image recording apparatus according to an embodiment of the present invention is explained below.

When an image is recorded to the recording material 42, the image recording apparatus according to the present embodiment requests an operator to input an image recording condition when the image data to be recorded is input to the control unit 1 through the interface not shown in the attached drawings. The prompt is issued by, for example, the notification unit 14 displaying a message to request input or notifying by voice output.

The image recording conditions input at this time include the size and type of the available recording material 42, the designation of one-sided recording or double-sided recording, the detailed image recording condition, the setting of conditions required to record an image, etc. These conditions are not limited to those described above, a prompt is appropriate issued depending on the configuration of the image recording apparatus, the use environment conditions, etc., and these are inputted by an operator.

The image recording conditions are input by an operator through the notification unit 14, and stored in the RAM of the control unit 1. In the present embodiment, a default image recording condition is stored in the ROM in advance. When there is no input from the operator, the default image recording condition is read from the ROM to automatically set the recording condition. The control unit 1 can be designed not to issue a prompt to the operator, but to set the image recording condition only when the operator requests to input the settings of the image recording conditions through the notification unit 14.

In setting the above-mentioned image recording conditions, the image recording conditions can be input to the control unit 1 through a predetermined interface from an upper device such as a computer, etc. connected to the image recording apparatus according to the present embodiment, and then displayed on the notification unit 14.

After the image recording conditions are thus set, the control unit 1 performs an image recording process.

The process performed by the image recording apparatus according to the present embodiment on the incorrect detection by the recording material detection unit 5 is described below by referring to FIGS. 4 through 6.

The line sensor of the recording material detection unit 5 can cause incorrect detection on the recording material 42 due to the detection position which is dirty with a piece of waste-paper, etc., as described above.

The image recording apparatus according to the present embodiment measures the output signal level in the recording material detection unit 5 in the non-detection state in which the recording material 42 is not set at a detection position of the recording material detection unit 5 before an image is recorded to the recording material 42.

Figure 4:
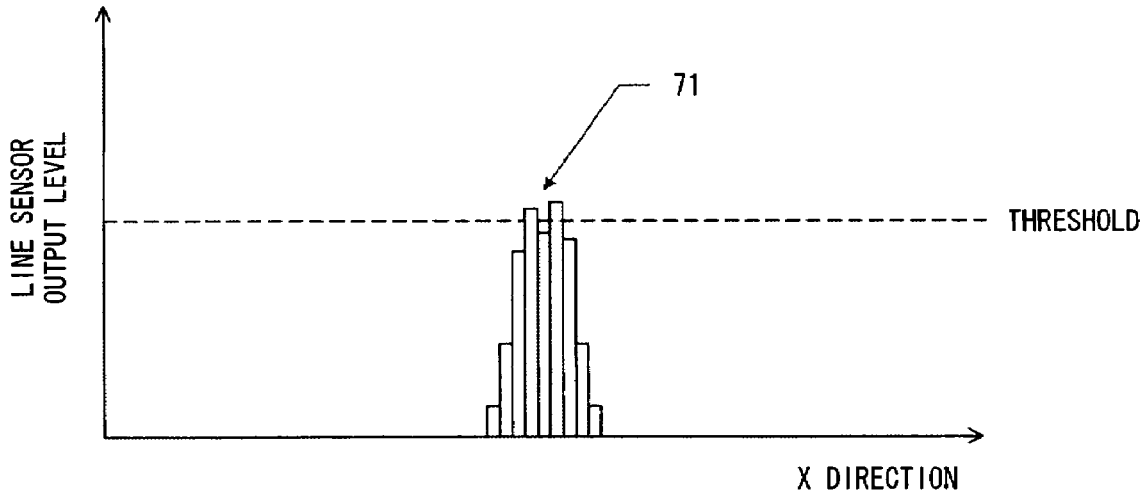
FIG. 4 is a first explanatory view of the process performed on the incorrect detection by the recording material detection unit.

FIG. 4 is a graph showing the output signal level in the recording material detection unit 5. FIG. 4 shows a horizontal axis indicating the position in the X direction (horizontal scanning direction) of the detection position in the transport path, and a vertical axis indicating the output signal level of the recording material detection unit 5.

In FIG. 4, there is an error detection position 71 where the output signal level exceeds a threshold, and the portion refers to an incorrect detection portion.

The recording material detection unit 5 is used to detect the edges on both sides of the recording material 42 in order to obtain an area where an image can be recorded. Therefore, although there is incorrect detection found at a portion other than a detection range such as the central portion, etc. where an edge portion of the recording material 42 is to be detected, an edge can be detected on either sides of the recording material 42.

Figure 5:
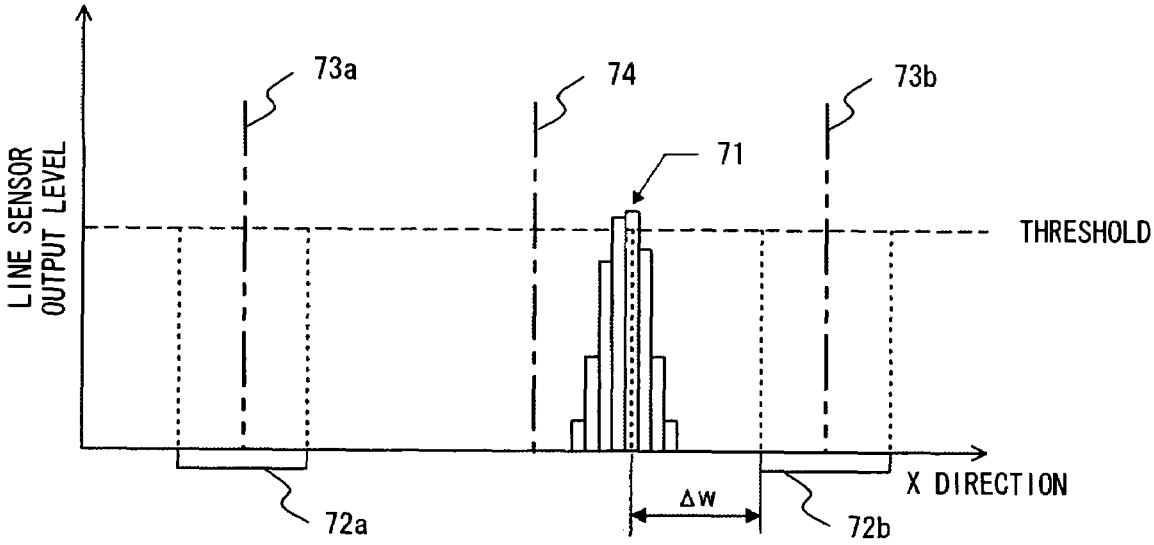
FIG. 5 is a second explanatory view of the process performed on the incorrect detection by the recording material detection unit.

FIG. 5 shows the above-mentioned case.

The recording material 42 is fed by the above-mentioned feed table 21 and transported in the transport path. The positions of both ends of the recording material 42 in the X direction substantially match the positions of the fences 22*a* and 22*b*. Therefore, in FIG. 5, the vicinity of the positions 73*a* and 73*b* corresponding to the fences 22*a* and 22*b* is defined as edge detection ranges 72*a* and 72*b* of the recording material 42. In FIG. 5, if the distance ΔW between the error detection position 71 exceeding the threshold and the edge detection ranges 72*a* and 72*b* is equal to or higher than a predetermined value, it is considered that the line sensor can detect an edge, and the edges of the recording material 42 are detected using the output of the recording material detection unit 5.

There is also a case where incorrect detection can be found in one of the two edge detection ranges 72*a* and 72*b*. FIG. 6 shows the case.

Figure 6:
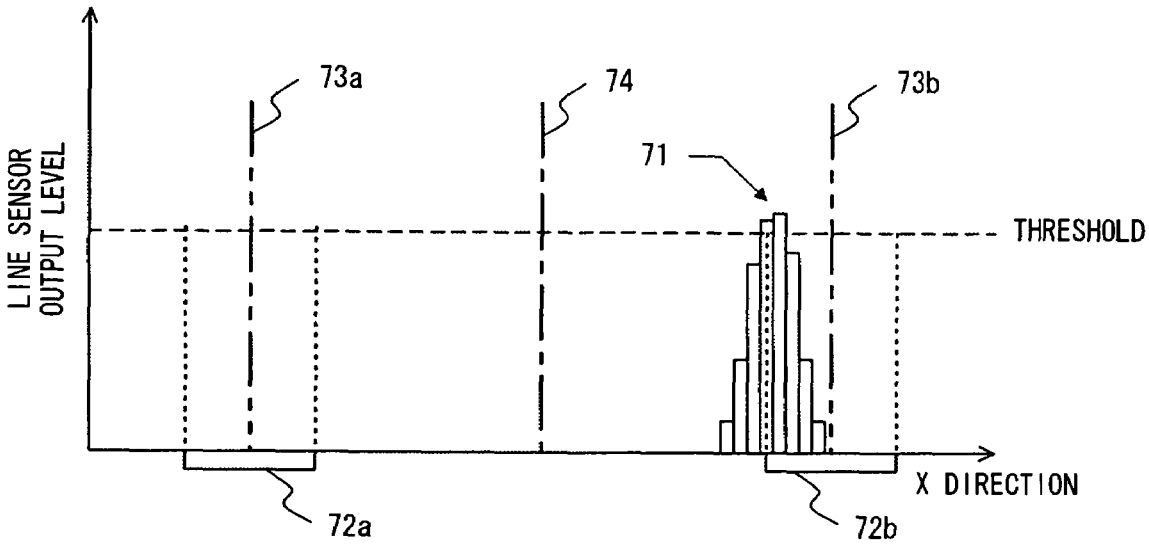
FIG. 6 is a third explanatory view of the process performed on the incorrect detection by the recording material detection unit.

In FIG. 6, the error detection position 71 is in the edge detection range 72*b*, and the recording material detection unit 5 cannot detect an edge in the edge detection range 72*b*.

In this case, the image recording apparatus according to the present embodiment detects an edge of the recording material 42 only in the edge detection range 72*a*, and the other edge of the recording material 42 is calculated based on the position of the edge detected in the edge detection range 72*a* and the information about the width W of the recording material 42 obtained by the potentiometer of the first detection unit 10.

When incorrect detection is found in both edge detection ranges 72*a* and 72*b*, the position of the edge is calculated only from the width W of the recording material 42 obtained by the potentiometer (described later).

Thus, the image recording apparatus according to the present embodiment can obtain the edge of the recording material 42 although the recording material detection unit 5 causes incorrect detection. Therefore, an image can be recorded on a portion close to either end of the recording material 42.

Next, the details of the operation of the image recording apparatus according to the present embodiment are explained below by referring to the flowcharts shown in FIGS. 7 and 8.

Figure 7:
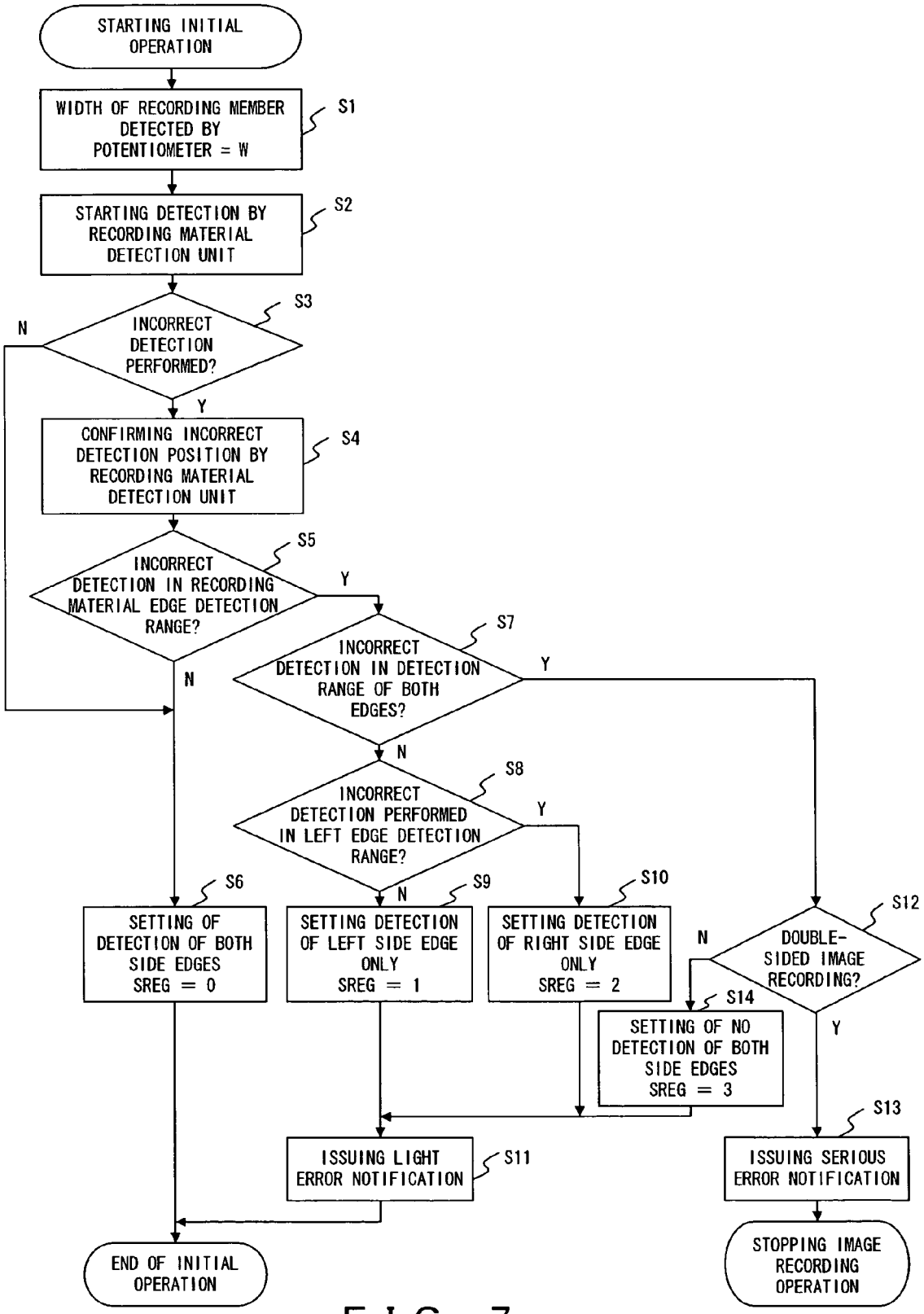
FIG. 7 is a flowchart of the initial operation in the image recording process by the image recording apparatus according to the present embodiment.

FIG. 7 is a flowchart of the initial operation in the image recording process by the image recording apparatus according to the present embodiment. The processes shown in FIGS. 7 and 8 are realized by the CPU in the control unit 1 executing the program stored in advance in the ROM in the control unit 1.

The program includes the program for the operation mode determination unit 15 for determining the method of detecting an edge of a recording material as described above, and the program for the recording position amendment unit 2 for determining the image recording position of the recording material.

The potentiometer in the first detection unit 10 indicates the positions of the fences 22*a* and 22*b* as resistance values as described above, and the resistance values of the potentiometer are announced to the control unit 1, thereby obtaining the width and the position information about the recording material 42 stored in the feed table 21.

The control unit 1 first measures the resistance value of the potentiometer to detect the width of the recording material 42 as the initial operation of the image recording process, and calculates the width W of the recording material from the width of the fences 22*a* and 22*b* (step S1).

Next, the control unit 1 confirms whether or not the width W of the recording material 42 has been specified by the input of the operator in advance or it matches the image recording condition specified by the upper device. If it does not match the condition, the control unit 1 announces it using the notification unit 14, or notifies the upper device of the image recording apparatus through a predetermined interface that the size information about the recording material 42 set in the image recording apparatus is different from the specified condition.

In step S2, the control unit 1 obtains a signal when the line sensor of the recording material detection unit 5 has not detected the recording material 42, that is, when the recording material 42 is not located in the detection position of the line sensor. In this case, if it is a normal status (N in step S3), the level of the signal is lower than a threshold in all detection positions in the horizontal scanning direction (X direction).

When the recording material detection unit 5 performs incorrect detection in which the signal level reaches or exceeds the threshold due to the dirt with a piece of wastepaper, etc. (Y in step S3), the control unit 1 confirms in step S4 whether or not the position of the incorrect detection is in the detection range.

Then, the control unit 1 performs A/D conversion on an analog signal from the recording material detection unit 5 in step S4, and when the digital value equals or exceeds a predetermined threshold as shown in FIG. 4, then it discriminates that there is dirt such as a piece of wastepaper, etc. on the surface detected by the recording material detection unit 5 corresponding to the detection position.

However, when the detection position is displaced by a value equal to or exceeding a predetermined value as shown in FIG. 5, that is, when the distance ΔW from the incorrect detection position to the edge detection ranges 72*a* and 72*b* of the recording material with the positions 73*a* and 73*b* corresponding to the fences 22*a* and 22*b* centered is equal to or exceeds a predetermined value (N in step S5), the control unit 1 determines that the incorrect detection position does not negatively affects the detection of the edge position of the recording material 42.

Therefore, the control unit 1 detects both side edges of the recording material 42 using the recording material detection unit 5 as in the case where there is no incorrect detection in step S3, and notifies the recording position amendment unit 2 described later of the detected data.

If the control unit 1 determines that the recording position amendment unit 2 described later can adopt as is the position information about both side edges of the recording material 42 obtained by the recording material detection unit 5, then it allows the operation setting register SREG of the operation mode determination unit 15 to set the value of, for example, "0", indicating the selected operation mode (step S6), thereby terminating the initial operation shown in FIG. 7.

However, if the control unit 1 determines in step S5 that the incorrect detection is found in one of the edge detection ranges 72*a* and 72*b* of the recording material 42 as shown in FIG. 6 (Y in step S5), then it determines in step S7 whether or not the incorrect detection has been detected in both edge detection ranges 72*a* and 72*b*.

When the control unit 1 determines that the incorrect detection has been performed on one side edge (N in step S7), it is determined in step S8 on which side the incorrect detection has been performed.

When the control unit 1 determines that the incorrect detection has been performed in the edge detection range of the right side (N in step S8), it calculates the edge positions on both sides based on the position of the left side edge detected by the recording material detection unit 5 and the width W of the recording material 42 detected by the above-mentioned potentiometer.

The control unit 1 notifies the recording position amendment unit 2 described later of the calculated edge positions of both sides, and allows the operation setting register SREG of the operation mode determination unit 15 to set, for example, "1" indicating the selected operation mode (step S9).

Furthermore, when the control unit 1 determines that the incorrect detection has been performed in the edge detection range in which the left side edge is detected (Y in step S8), the positions of the both side edges are calculated based on the position of the right side edge detected by the recording material detection unit 5 and the width W of the recording material 42 detected by the above-mentioned potentiometer.

The control unit 1 notifies the recording position amendment unit 2 of the calculated positions of both side edges, and allows the operation setting register SREG of the operation mode determination unit 15 to set, for example, "2" indicating the selected operation mode (step S10).

If the control unit 1 determines that the recording material detection unit 5 has performed incorrect detection on both side edges (Y in step S7), and if the image recording request indicates recording an image on one side of the recording material 42 (N in step S12), then it calculates the width W of the recording material 42 and the positions of both side edges detected by the above-mentioned potentiometer. The calculation is performed because the transport path of the recording material 42 is relatively short and the slippage in the horizontal scanning direction when the recording material 42 reaches the recording head 8 from the feed system 9 is very small.

The control unit 1 notifies the recording position amendment unit 2 described later of the calculated positions of both side edges, and allows the operation setting register SREG of the operation mode determination unit 15 to set, for example, "3" indicating the operation mode (step S14).

The control unit 1 can record an image in the appropriate masking process by the amendment by the recording position amendment unit 2 described later. However, when it determines that the recording material detection unit 5 has performed incorrect detection, it announces the light error (maintenance request) from the notification unit 14 (step S11), thereby terminating the initial operation shown in FIG. 7.

The light error (maintenance request) is announced by the notification unit 14, or can be directly announced to an upper device such as a computer, etc. from the control unit 1 through the interface not shown in the attached drawings. The light error refers to a message to an operator to check and clean the recording material detection unit 5, that is, does not require an immediate stop of the image recording apparatus.

When recording an image on both sides is set as an image recording condition, the control unit 1 stops an image recording operation because there is the possibility that the recording material 42 can be slipped in the horizontal scanning direction until the recording material 42 is transported again to the recording head 8 since the transport path to the position where an image is recorded to the reverse after recording an image to the surface of the recording material 42 is long.

Therefore, when the recording material detection unit 5 cannot detect at least one side edge of the recording material 42, the control unit 1 determines that an image cannot be recorded with an appropriate masking process on the reverse, and stops the double-sided image recording.

When the recording material detection unit 5 perform incorrect detection on both edges (Y in step S7), and when the image recording condition refers to double-sided image recording (Y in step S12), the control unit 1 allows the notification unit 14 to announce a serious error (serviceman call), or the control unit 1 directly notifies the upper device such as a computer, etc. through the interface not shown in the attached drawings of the serious error (serviceman call) (step S13), thereby performing the process of stopping the image recording operation.

Figure 8:
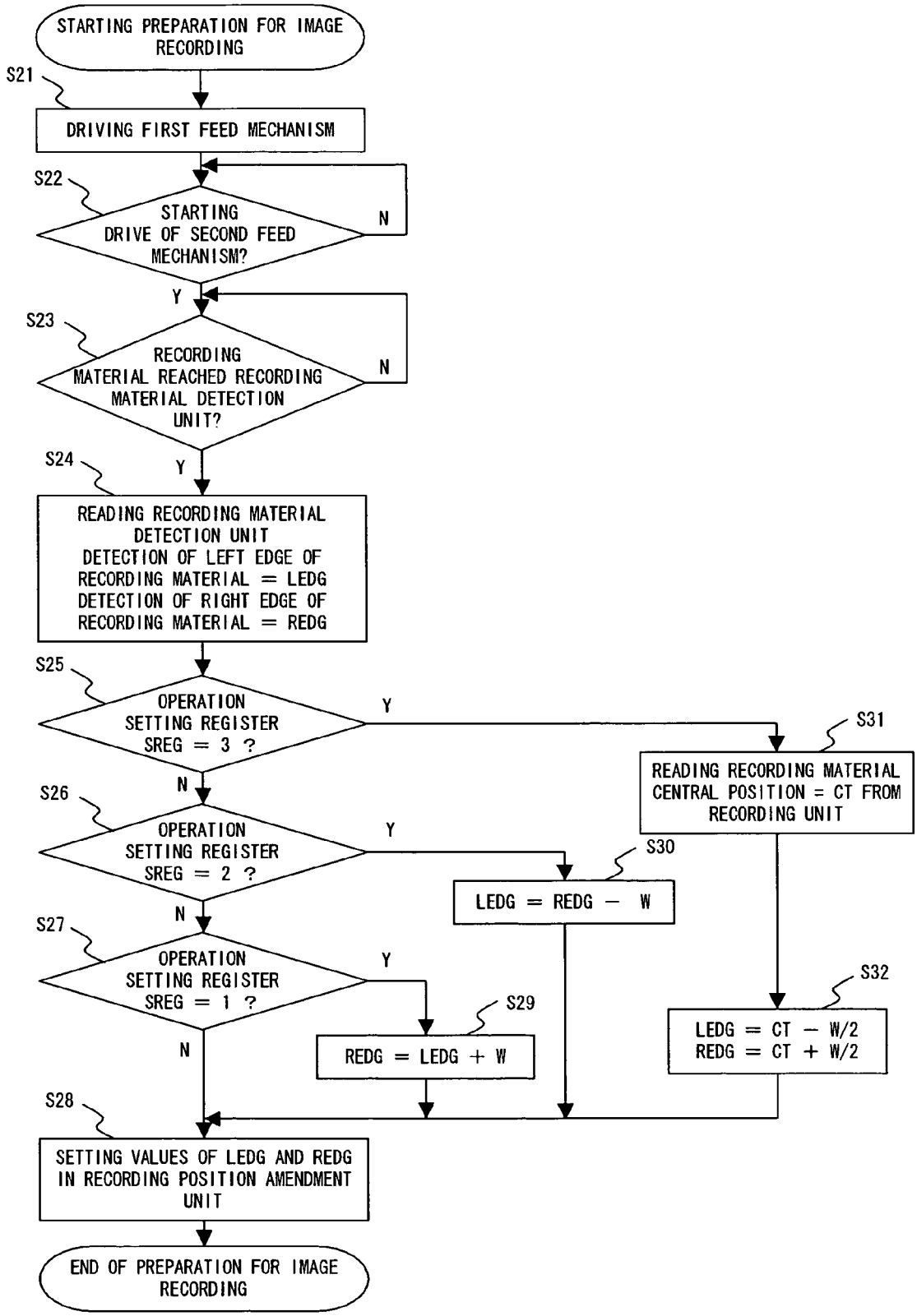
FIG. 8 is a flowchart of the image recording process performed after the initial operation.

FIG. 8 is a flowchart of the image recording process after the initial operation shown in FIG. 7.

The control unit 1 calculates the positions of both side edges in the calculating method based on the set value set by the operation setting register SREG through the operation mode determination unit 15 according to the flowchart of the initial operation shown in FIG. 7.

The control unit 1 adds the image recording timing information at the time of recording an image to the recording material 42 to the information about the calculated position of both side edges, notifies the recording position amendment unit 2 of the appropriate mask information (recording position amendment information), and allows the recording position amendment unit 2 to store the appropriate mask information (recording position amendment information) at the time of recording an image to the recording material 42.

The control unit 1 allows an image to be recorded when the image is recorded on the recording head 8 according to the appropriate mask information (recording position amendment information), stored in the recording position amendment unit 2, at the time of recording an image to the recording material 42.

The relationship between the information about the positions of both side edges and the image recording timing when an image is recorded to the recording material 42 is explained by referring to FIG. 2.

As shown in FIG. 2, the image recording apparatus is provided with the image recording unit 6 having the recording material detection unit 5 and the recording head 8 upward to downward in the transport path of the recording material 42, and also provided with the transport mechanism 3 having the transport information generation unit 4 opposite the nozzle string 8*a* of the recording head 8.

The distance between the components is determined by the set value during the production of the image recording apparatus, and is assigned a predetermined value.

The encoder in the transport information generation unit 4 of the transport mechanism 3 generates an amount of travel of a belt when the recording material 42 is loaded on the endless belt 24 and transported, and notifies the control unit 1 of the amount.

The control unit 1 can record an image to the recording material 42 at a predetermined image recording timing by storing a predetermined value corresponding to the distance (for example, the difference between the recording material detection unit 5 and the nozzle string 8*a* of the recording head 8 is 100 encoder generated pulses, etc.).

Therefore, the control unit 1 notifies the recording position amendment unit 2 of the information about the positions of both side edges associated with the number of encoder pulses in the transport information generation unit 4 when the recording material detection unit 5 detects, for example, the positions of both side edges of the recording material 42.

Thus, the recording position amendment unit 2 appropriately amends the masking position (recording position amendment) to the recording material 42 based on the number of pulses corresponding to the associated information and the above-mentioned distance notified by the control unit 1, thereby recording an image.

The control unit 1 turns on the clutch by issuing a drive instruction to the driving power transmission system in step S21, and rotates the pickup roller 12*a* in the first feed mechanism 12. Thus, the pickup roller 12*a* picks up a piece of the recording material 42 from the feed table 21, and transports the recording material 42 in the transport direction to the pair of registration rollers in the second feed mechanism 13.

The control unit 1 corrects the diagonal transport during the transport of the recording material 42 using the pair of registration rollers. Practically, the control unit 1 drives the pickup roller 12*a*, transports the recording material 42 in the transport path, and pushes the end portion of the recording material 42 to the pair of registration rollers arranged substantially parallel to the horizontal scanning direction. At this time, the pair of registration rollers are not driven (rotated) (N in step S22), and the direction of the recording material 42 can be diagonal (diagonal to the transport direction). The second detection unit 11 (registration sensor) detects the end of the recording material 42 in the vertical scanning direction and notifies the control unit 1 immediately before the recording material 42 is pushed to the pair of registration rollers.

After the second detection unit 11 (registration sensor) drives the pickup roller 12*a* for a predetermined time after detecting the recording material 42 to allow the recording material 42 to contact the pair of registration rollers, the control unit 1 further feeds the recording material 42 and pushes it into the pair of registration rollers.

Thus, the direction of the recording material 42 is adjusted to subsequently match the horizontal scanning direction.

After correcting the diagonal state of the recording material 42, the control unit 1 allows the pair of registration rollers to nip the recording material 42 to start transporting the recording material 42 (Y in step S22), and allows the recording material 42 to be transported to the transport mechanism 3, thereby performing the image recording process.

In the image recording process, for example, when the recording material 42 is transported from the feed system 9 and the registration sensor 11 detects the end portion of the recording material 42 in the vertical scanning direction, the control unit 1 issues a drive instruction to the motor 26 to drive the endless belt 24 and the platen suction unit 28.

Thus, the recording material 42 nipped by the above-mentioned pair of registration rollers is loaded on the endless belt 24 under suction, and transported downward in the transport path.

Before the recording material 42 held under suction on the endless belt 24 of the transport mechanism 3 is transported to the position opposite the nozzle string 8*a* of the recording head 8 in the image recording unit 6, the control unit 1 allows the recording material 42 to reach the line sensor in the recording material detection unit 5 (step S23) so that the line sensor can detect both side edges (LEDG, REDG) of the recording material 42 (step S24).

At this time, if the set value of the operation setting register SREG for setting the operation mode is "3" (Y in step S25) in the initial operation (process of the flowchart shown in FIG. 7), then the line sensor has performed incorrect detection and the line sensor is not to set both edges of the recording material 42. Therefore, the control unit 1 calculates the width information about the recording material 42 by the width W measured based on the resistance value of the potentiometer connected to the fences 22*a* and 22*b*.

As shown in FIG. 3, the fences 22*a* and 22*b* are moved to the center of the feed table 21 in the horizontal scanning direction, that is, to the positions at the same difference from the center in the horizontal scanning direction in the transport path. Thus, the center position of the feed table 21 matches the center position of the recording material 42.

The control unit 1 stores the center position CT of the transport path in the storage unit not shown in the attached drawings in advance when the apparatus is adjusted and delivered.

The control unit 1 reads the stored center position CT of the transport path in step S31. In step S32, the both side edges of the recording material 42 are calculated by the width W of the recording material 42.

That is, the left side edge position LEDG of the recording material 42 is obtained by the equation LEDG=CT−W/2, and the right side edge position REDG of the recording material 42 is obtained by the equation REDG=CT+W/2. The relationship between the coordinates of the left and right side edges is represented by LEDG<REDG.

It is determined when the set value of the operation setting register SREG is "2" (N in step S25 and Y in step S26) that the line sensor of the recording material detection unit 5 can perform incorrect detection in the edge detection range in which the left side edge of the recording material 42 is detected.

Therefore, the control unit 1 does not use the edge data LEDG indicating the position of the left side detected by the line sensor in step 24, but calculates in step S30 the position of the left side edge by the edge data REDG indicating the position of the right side edge and the width W measured by the resistance value of the potentiometer connected to the fences 22*a* and 22*b*.

At this time, the calculation of the left side edge data LEDG is obtained by the equation LEDG=REDG−W.

It is determined when the set value of the operation setting register SREG is "1" (N in step S26 and Y in step S27) that the line sensor of the recording material detection unit 5 can perform incorrect detection in the edge detection range in which the right side edge of the recording material 42 is detected.

Therefore, the control unit 1 does not use the edge data REDG indicating the position of the right side detected by the line sensor, but calculates in step S29 the position of the right side edge by the edge data LEDG indicating the position of the left side edge and the width W measured by the resistance value of the potentiometer connected to the fences 22*a* and 22*b*.

At this time, the calculation of the right side edge data REDG is obtained by the equation REDG=LEDG+W.

When the operation mode (set value of the operation setting register SREG) is set to "0" and the there is no possibility that the recording material detection unit 5 performs incorrect detection, the positions of both side edges of the recording material 42 are appropriately detected. Therefore, the control unit 1 uses as is the data obtained by the line sensor of the recording material detection unit 5 as the information about the position of the edge of the recording material 42.

When the operation mode is set to "0", the control unit 1 can obtain the width information from the front end to the rear end in the vertical scanning direction of the recording material 42 with the information associated with the number of encoder pulses in the transport information generation unit 4 of the transport mechanism 3.

Therefore, for example, the α (α is an integer) lines (one or more lines) of image data are recorded for the image data to be recorded to the recording material 42, the control unit 1 can record the image according to the width information β (β is an integer) corresponding to the α lines of image data. Thus, although, for example, a part of the recording material 42 is folded and the recording material 42 becomes indefinite in shape after the pair of registration rollers in the second feed mechanism pass, the control unit 1 can record an image by allowing the recording position amendment unit 2 to make an application masking position amendment.

When the operation mode is set to any of "1", "2", and "3", the control unit 1 cannot make an appropriate masking position amendment to the recording material 42 a part of which is folded to make an indefinite-shaped recording material 42 of the operation "0".

However, with the configuration according to the present embodiment, as shown in FIG. 2, since it is rare that the recording material 42 is transported to the recording material detection unit 5 after the recording material 42 which has become indefinite in shape passes the pair of registration rollers. Therefore, the masking position amendment can be made without problems if the operation mode is set to any of "1", "2", and "3" during the image recording process.

When the operation mode is set to any of "1", "2", and "3", the notification unit 14 announces the maintenance request for a light error as described above. Therefore, the operator can determine whether or not the image recording process can be continued after the announcement.

As described above, the control unit 1 calculates the positions of both side edges based on the status of the recording material detection unit 5, notifies the recording position amendment unit 2 of the calculated result, and allows the recording position amendment unit 2 to store the both side edge data LEDG and REDG (step S28), thereby completing the preparation for an appropriate masking position amendment (recording position amendment) to the recording material 42.

When the preparation for recording an image shown in FIG. 8 is completed, the control unit 1 continues transporting the recording material 42 to the position opposite the nozzle string 8*a* of the recording head 8 in the image recording unit 6 by driving the endless belt 24 of the transport mechanism 3.

The control unit 1 transports the recording material 42, adds the marginal data set by the operator to the recording position amendment unit 2, and records an image.

The marginal data refers to the image data recording start position/recording end position inside from the end portions of the recording material 42 in the vertical scanning direction, and the image data recording start position/recording end position inside from the side end portions of the recording material 42 in the horizontal scanning direction.

Therefore, the marginal data in the vertical scanning direction practically refers to setting of the number of encoder pulses in the transport information generation unit 4 of the transport mechanism 3.

When recording an image to one side of the recording material 42 is set as an image recording condition, the control unit 1 switches the transport path switch unit 31 to the ejection system 50, and stores the recording material 42 to which an image is recorded in the ejection tray 32 after being transported by the pair of ejection rollers 30.

When recording an image to both sides of the recording material 42 is set as an image recording condition, the control unit 1 issues a drive instruction to the transport path switch unit 31 to make switch to allow the end of the transport path switch unit 31 contact an ejection path 30*b*. Thus, the recording material 42 is lead to the recording material reverse unit 60.

The control unit 1 transports the recording material 42 from the first transport path 33 to the second transport path 61, and furthermore transports it to the slope unit 35 through the reverse belt unit 34. The recording material 42 transported to the slope unit 35 presses the gate 36, and turns the gate 36 toward the reverse path unit 62. Thus, the recording material 42 is led by the gate 36 and the slope unit 35 and transported to the reverse path unit 62.

The control unit 1 nips the recording material 42 led by the reverse path unit 62 using the pair of reverse rollers 37.

After nipping the recording material 42 using the pair of reverse rollers 37, the control unit 1 transports the recording material 42 to the reverse auxiliary path 38 by forwarding the pair of reverse rollers 37, thereby transporting the recording material 42 to the reverse auxiliary path 38. By the transportation, the recording material 42 slips outside the detection range of the end portion detection sensor 39.

The control unit 1 stops the pair of reverse rollers 37 at the position where the end portion detection sensor 39 stops detecting the recording material 42, that is, at the rear end position of the recording material 42. Afterwards, the control unit 1 reverses the pair of reverse rollers 37, and transports the recording material 42 to the re-feed transport path 40.

At this time, the gate 36 is released from the pressure of the recording material 42 and is separated from the reverse path unit 62. Therefore, the recording material 42 is led to the re-feed transport path 40.

The control unit 1 nips by the pair of re-feed rollers 41 the recording material 42 transported to the re-feed transport path 40, and transports the recording material 42 to the pair of registration rollers.

When the pair of re-feed rollers 41 and the pair of registration rollers correct the diagonal state of the recording material 42, the control unit 1 corrects the diagonal state of the recording material 42 as in the operation of correcting the diagonal state by the pickup roller 12*a* and the pair of registration rollers.

Thus, the control unit 1 transports the reversed recording material 42 to the image recording unit 6, and calculates the positions of both side edges of the recording material 42 in any operation mode set in the process shown in FIGS. 7 and 8 as in the case of the above-mentioned one-side image recording.

The control unit 1 adds the image recording timing information at the time of recording an image to the recording material 42 to the information about the calculated positions of both side edges, notifies the recording position amendment unit 2 of the appropriate mask information (recording position amendment information), and allows the recording position amendment unit 2 to store the appropriate mask information (recording position amendment information) at the time of recording an image to the recording material 42.

The control unit 1 records an image with the image recording timing of the recording head 8 according to the appropriate mask information (recording position amendment information), stored in the recording position amendment unit 2, at the timing of recording an image to the recording material 42.

When an image is completely recorded to both sides of the recording material 42, the control unit 1 switches the transport path switch unit 31 to the ejection system 50, and stores the recording material 42 transported by the pair of ejection rollers 30 in the ejection tray 32.

As described above, according to the image recording apparatus of the present embodiment, although the recording material detection unit 5 is in the state of possibly performing incorrect detection, an image can be recorded in an appropriate position of the recording material 42. At this time, the image is recorded by obtaining both side edges of the recording material 42. Therefore, the image can be recorded in the range near both ends of the recording material 42 in the horizontal scanning direction.

In the present embodiment, when there is the possibility that the recording material detection unit 5 can perform incorrect detection, the information about the positions of both side edges of the recording material 42 is calculated based on the detection result of the recording material detection unit 5 and the detection result of the first detection unit 10 in the feed system 9. However, for example, the calculation can be performed according to the information about the size (definite/indefinite), etc. of the recording material 42 set/notified by an operator, an upper device, etc. instead of the detection result of the first detection unit 9.

The present embodiment shows the configuration of the image recording apparatus as a printer device, but the image recording apparatus according to an embodiment of the present invention is not limited to this configuration. That is, the present invention can be applied to a general device for storing an image on a recording material based on image data such as a FAX device, a copying device, etc.

What is claimed is:

1. An image recording apparatus including a transport path of a recording material, and an image recording unit in the transport path which records an image in the recording material during transportation of the recording material in the transport path, the image recording apparatus comprising:

a recording material detection unit which is provided in the transport path and which detects at least one edge at a side end of the recording material transported in the transport path;

an operation mode determination unit discriminating whether an incorrect detection can be performed in detecting the edge by the recording material detection unit, and determining an operation mode based on a discrimination result; and a control unit which controls the image recording unit to perform an image recording process on the recording material in the operation mode, wherein when the operation mode determination unit discriminates that the incorrect detection can be performed only on detection of a first edge of the recording material, the operation mode determination unit determines an operation mode of performing the image recording process using a detection result on a second edge.

2. The image recording apparatus according to claim 1, further comprising a recording material reverse unit in the transport path for recording an image to both sides of the recording material.

3. The image recording apparatus according to claim 1, further comprising in the transport path a transport mechanism which is mounted opposite the image recording unit, and which includes a transport information generation unit for generating an amount of travel in transport of the recording material when the recording material is loaded and transported downward in the transport path, wherein the transport mechanism notifies the control unit of the amount of travel of the recording material.

4. The image recording apparatus according to claim 3, wherein the control unit instructs the image recording unit to record the image based on the notified amount of travel of the recording material.

5. The image recording apparatus according to claim 1, further comprising in the transport path a transport mechanism which is mounted opposite the image recording unit, and which includes a transport information generation unit for generating an amount of travel in transport of the recording material when the recording material is loaded and transported downward in the transport path, wherein the control unit stores information about edge detection of the recording material detection unit after associating the information with the amount of travel of the recording material notified by the transport mechanism.

6. The image recording apparatus according to claim 5, wherein the control unit comprises a recording position amendment unit storing the information about the edge detection.

7. The image recording apparatus according to claim 1, wherein when the operation mode determination unit discriminates that the incorrect detection can be performed on detection of both edges of the recording material, the operation mode determination unit determines an operation mode of performing the image recording process without using a detection result by the recording material detection unit.

8. The image recording apparatus according to claim 7, wherein when the operation mode determination unit determines the operation mode of performing the image recording process without using the detection result by the recording material detection unit, double-sided image recording is not performed on the recording material.

9. The image recording apparatus according to claim 1, wherein when a position where the incorrect detection can be performed by the recording material detection unit is not in an edge detection range used in detecting the edge of the recording material, the operation mode determination unit determines an operation mode of performing the image recording process using a detection result on both edges of the recording material by the recording material detection unit.

10. The image recording apparatus according to claim 1, further comprising:

a feed system which is mounted upward in the transport path, and which ejects the recording material in the transport path; and a first detection unit detecting a width of the recording material set in the feed system, wherein when the operation mode determination unit discriminates that the incorrect detection can be performed, the operation mode determination unit determines the operation mode of performing the image recording process using a detection result by the first detection unit.

11. The image recording apparatus according to claim 1, wherein the operation mode determination unit further comprises a notification unit notifying an operator of contents of the discrimination that the incorrect detection can be performed.

12. An image recording apparatus including a transport path of a recording material, and an image recording means in the transport path which records an image in the recording material during transportation of the recording material in the transport path, the image recording apparatus comprising:

recording material detection means which is provided in the transport path and which detects at least one edge at a side end of the recording material transported in the transport path;

operation mode determination means for discriminating whether an incorrect detection can be performed in detecting the edge by the recording material detection means, and determining an operation mode based on a discrimination result; and control means for controlling the image recording means to perform an image recording process on the recording material in the operation mode;

wherein when the operation mode determination means discriminates that the incorrect detection can be performed only on detection of a first edge of the recording material, the operation mode determination means determines an operation mode of performing the image recording process using a detection result on a second edge.

13. An image recording method for an image recording apparatus including a transport path of a recording material, and an image recording unit in the transport path which records an image in the recording material during transportation of the recording material in the transport path, the method comprising:

discriminating before an edge at a side end of the recording material transported in the transport path is detected whether an incorrect detection can be performed when the edge is detected;

determining based on a discrimination result an operation mode indicating whether the image is recorded using a detection result of the edge;

calculating an appropriate mask information by detecting the edge of the recording material in the determined operation mode; and recording the image on the recording material according to the calculated appropriate mask information.

14. The image recording method according to claim 13, wherein the image is recorded according to the appropriate mask information with image recording timing on a recording head of the image recording unit.

* * * * *